US006746293B1

(12) United States Patent
Kirby, Jr. et al.

(10) Patent No.: US 6,746,293 B1
(45) Date of Patent: Jun. 8, 2004

(54) FLOATING, STEERABLE SPA CHAIR

(76) Inventors: Dennis T. Kirby, Jr., 8338 Ritchie Hwy., Pasadena, MD (US) 21122; Lee E. Price, 8338 Ritchie Hwy., Pasadena, MD (US) 21122

( * ) Notice: Subject to any disclaimer, the term of this patent is extended or adjusted under 35 U.S.C. 154(b) by 0 days.

(21) Appl. No.: 10/392,920

(22) Filed: Mar. 21, 2003

(51) Int. Cl.[7] ..... B63C 9/08
(52) U.S. Cl. ..... 441/132; 440/38; 4/492
(58) Field of Search ..... 4/492; 441/130, 441/132; 440/38

(56) References Cited

U.S. PATENT DOCUMENTS

| | | | | |
|---|---|---|---|---|
| 3,092,101 A | | 6/1963 | Kinney | |
| 3,636,944 A | | 1/1972 | Bryant | |
| 4,115,888 A | * | 9/1978 | Sievers | 440/38 |
| 4,126,905 A | | 11/1978 | Russell et al. | |
| 4,149,281 A | | 4/1979 | Bob et al. | |
| 4,468,822 A | | 9/1984 | McKay | |
| 4,754,502 A | | 7/1988 | Bowen | |
| 4,986,781 A | | 1/1991 | Smith | |
| 5,080,091 A | | 1/1992 | Peterson et al. | |
| 5,088,723 A | | 2/1992 | Simmons | |
| 5,233,705 A | | 8/1993 | Coleman et al. | |
| 5,307,529 A | | 5/1994 | Wang | |
| 5,403,220 A | * | 4/1995 | Goad, Sr. | 441/130 |
| 5,722,596 A | | 3/1998 | Dome | |
| 5,984,744 A | | 11/1999 | Lutz | |
| 6,209,148 B1 | | 4/2001 | Hoffman et al. | |
| 6,250,977 B1 | | 6/2001 | Ness | |

* cited by examiner

*Primary Examiner*—Stephen Avila
(74) *Attorney, Agent, or Firm*—Rosenberg, Klein & Lee

(57) ABSTRACT

A floating steerable spa chair (10) is provided. The floating, steerable spa chair (10) includes an upper hollow frame (12) having at least one air inlet (16) and a plurality of air outlets (18) formed therein. The spa chair (10) further includes a lower hollow frame (14) having a water inlet (20) and first and second valves (22, 24) formed therein. The lower hollow frame (14) has a plurality of spa jets (26, 28) and plurality of propulsion jets (46) formed thereon. First valve (22) selectively controls water flow to spa jets (26, 28) and second valve (24) selectively controls water flow to propulsion jets (46), allowing a user (60) to control speed and steering of the spa chair (10) when the chair (10) is being propelled through water. Jets (26, 28, 46) are in communication with air outlets (18), allowing the water projected through the jets (26, 28, 46) to be aerated.

20 Claims, 8 Drawing Sheets

FLOATING, STEERABLE SPA CHAIR

BACKGROUND OF THE INVENTION

1. Field of the Invention

The subject invention relates to a floating, steerable spa chair. In particular, the present invention directs itself to a spa chair having a plurality of spa jets for showering a user with controlled streams of water. More particularly, this invention directs itself to a floating spa chair having a plurality of propulsion jets, allowing the floating spa chair to be propelled through water, with the user having control over both speed and direction.

Further, the floating, steerable spa chair includes an upper frame and a lower frame. The lower frame receives pressurized water for powering both the spa jets and the propulsion jets. The upper hollow frame carries air for aeration of the water projected by the jets. Additionally, this invention directs itself to a spa chair wherein the user may control the pressure and quantity of water being projected by both the spa jets and the propulsion jets.

2. Prior Art

Buoyant spa chairs are well-known in the art. In general, such spa chairs include some type of support means and a plurality of jets or other water projection means for dousing the user. Prior art spa chairs and the like do not allow the user to selectively control the speed and direction of travel through water. It is a purpose of the subject invention to provide a combination of elements making up a floating, steerable spa chair which allows the user to control the quantity and pressure of water projected through both the spa and propulsion jets, and further allows the user control over the speed and direction of travel through water.

One such prior art chair is shown in U.S. Pat. No. 6,209,148. The floating water massage device is a buoyant chair for use in a swimming pool having a body support structure formed with an opening through which pressurized fluid streams may be directed against the back of the user reclining on the device. The chair, however, does not include propulsion jets, nor does it allow the user any control over speed or direction of travel within the swimming pool.

Another such prior art system is shown in U.S. Pat. No. 4,126,905, which is directed to a floating therapy pool. A water supply inlet is used to circulate heated filtered water from a pool filtration system into a floating enclosure. An air discharge means in the lower part of the enclosure is employed to introduce air into the enclosure and create pressure waves within the enclosure with suitable generating means being used for supplying pressurized air into the enclosure through the air discharge opening. The floating therapy pool, however, does not include propulsion jets, nor does it allow the user any control over speed or direction of travel within the swimming pool.

U.S. Pat. No. 4,986,781 is directed to a floating lounge. The floating lounge has a lounge body that is adapted to support a person in a reclined position while floating in water. The lounge body has an enclosed fluid distribution chamber and orifices distributed throughout the top surface thereof for delivering small jets of fluid under pressure onto a person supported on the lounge body in a reclined position to provide massage-like action. The floating lounge, however, does not include propulsion means, nor does it allow the user any control over speed or direction of travel while floating in water.

U.S. Pat. No. 4,754,502 is directed to an inflatable bath. The self-standing inflatable bath may be floated in a swimming pool or other body of water. The bath is filled with water, or water is circulated through the bath. Pressurized steam is introduced into the bath to inflate the bath and to heat the water in the bath. The steam also serves to create bubbles in the bath water for therapeutic effects. Although the inflatable bath includes a water outlet for expelling water to a filter, it does not include propulsion means, nor does it allow the user any control over travel speed or direction.

Another prior art system is shown in U.S. Pat. No. 4,468,822, which is directed to a spa chair. The spa chair includes a conveying means connectable to a liquid source, such as the outlet pipe of a swimming pool, for conveying liquid to apertures or perforations formed in the spa frame. Liquid is expelled under pressure onto a person or persons supported by the frame. Aerating means are also included and are in communication with the water projecting means. The spa chair, however, does not include any propulsion means, nor does it allow for any user control over travel speed or direction within the swimming pool.

None of the prior art provides for a combination of elements forming a floating, steerable spa chair which includes a plurality of propulsion jets allowing a user selective control over speed and direction of travel through the body of water in which the spa chair floats. Additionally, none of the prior art systems allow for selective user control over pressure and quantity of water delivered to the spa and propulsion jets.

SUMMARY OF THE INVENTION

The present invention provides for a floating, steerable spa chair. The floating, steerable spa chair includes an upper hollow frame having at least one air inlet and a plurality of air outlets formed therein. The spa chair further includes a lower hollow frame having a water inlet and first and second valves mounted thereto. The lower hollow frame has a plurality of spa jets and a plurality of propulsion jets mounted thereto. The first valve allows a user to selectively control water flow to the spa jets and the second valve allows the user to selectively control water flow to the propulsion jets. The user has selective control over the quantity and pressure of water being delivered to both the spa and propulsion jets. Additionally, the user has selective control over the direction and speed of travel of the floating, steerable spa chair.

It is a principal objective of the subject floating, steerable spa chair to provide a resilient support for the body of a user made from a buoyant material.

It is a further objective of the subject floating, steerable spa chair to provide a plurality of spa jets for showering the user with controllable streams of water.

It is a further objective of the subject floating, steerable spa chair to provide a plurality of propulsion jets allowing the spa chair to be propelled through a body of water.

It is a further objective of the present invention to provide a floating, steerable spa chair having a first valve allowing the user to selectively control the quantity and pressure of water being delivered to the spa and propulsion jets.

It is an important objective of the present invention to provide a second valve allowing a user to selectively control speed and direction of travel of the spa chair.

DESCRIPTION OF THE PREFERRED EMBODIMENTS

Figure 1:
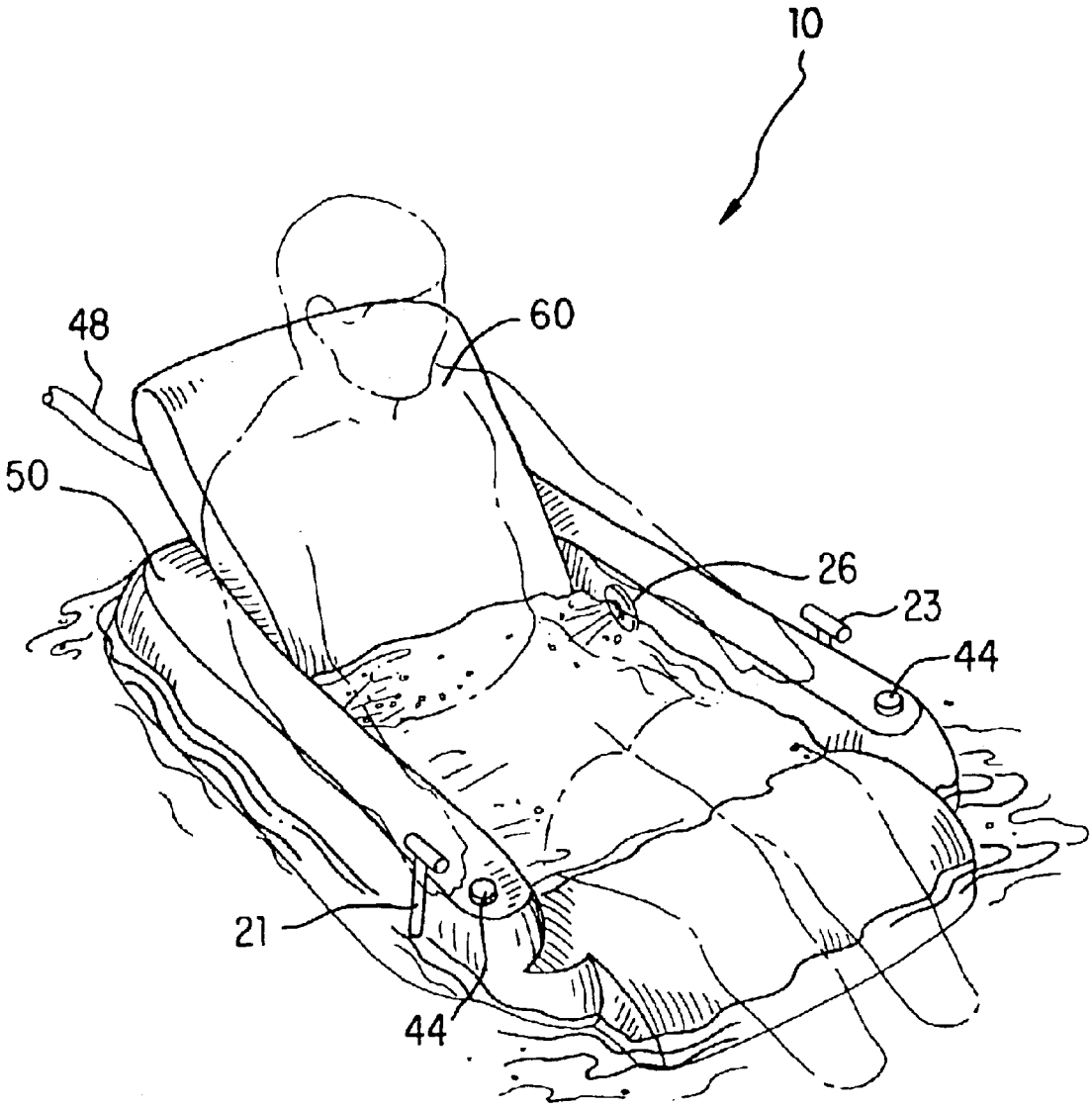
FIG. 1 is a perspective view of the floating, steerable spa chair in use.
Figure 2:
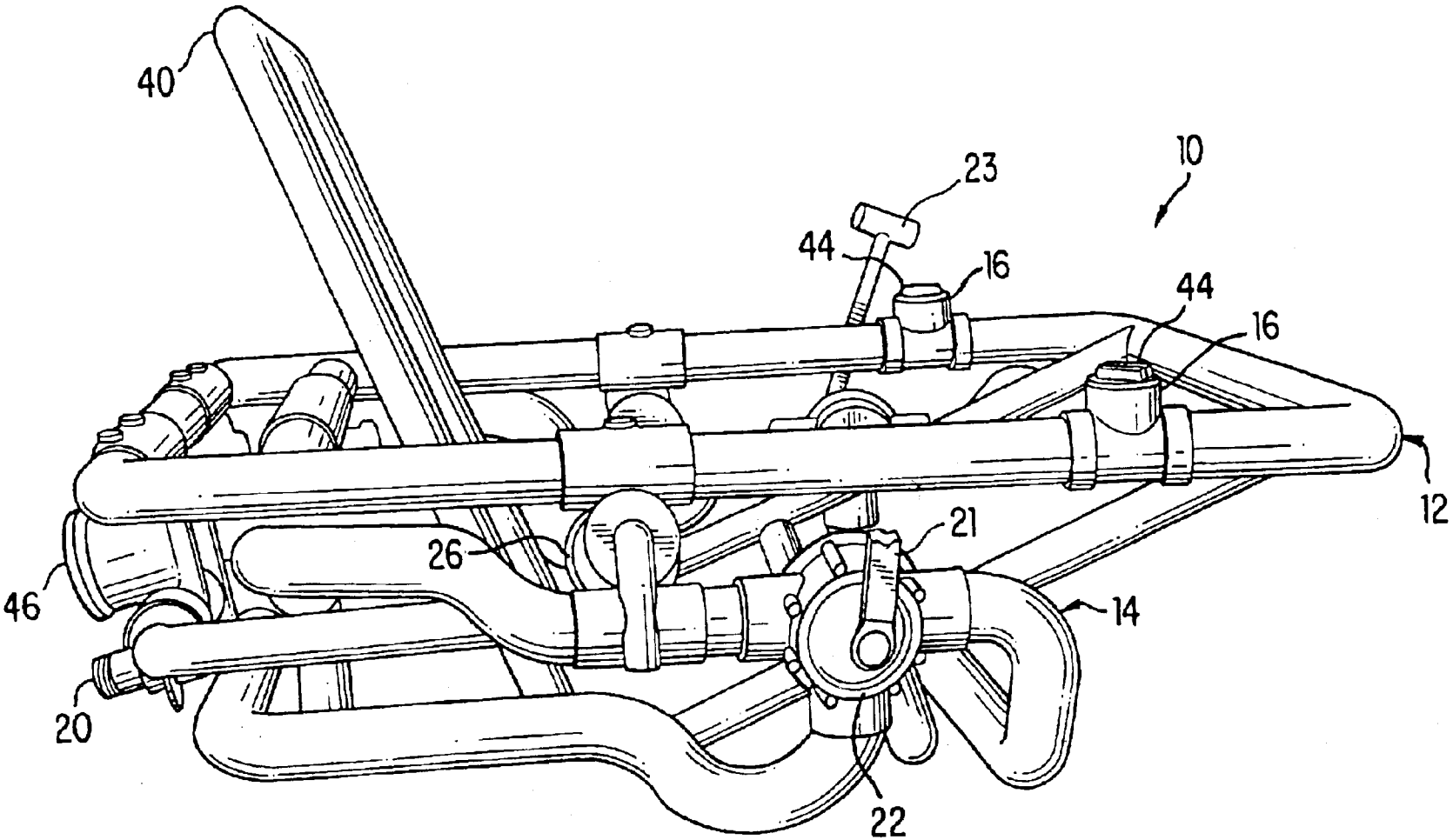
FIG. 2 is a side view of the internal structure of the floating, steerable spa chair.
Figure 3:
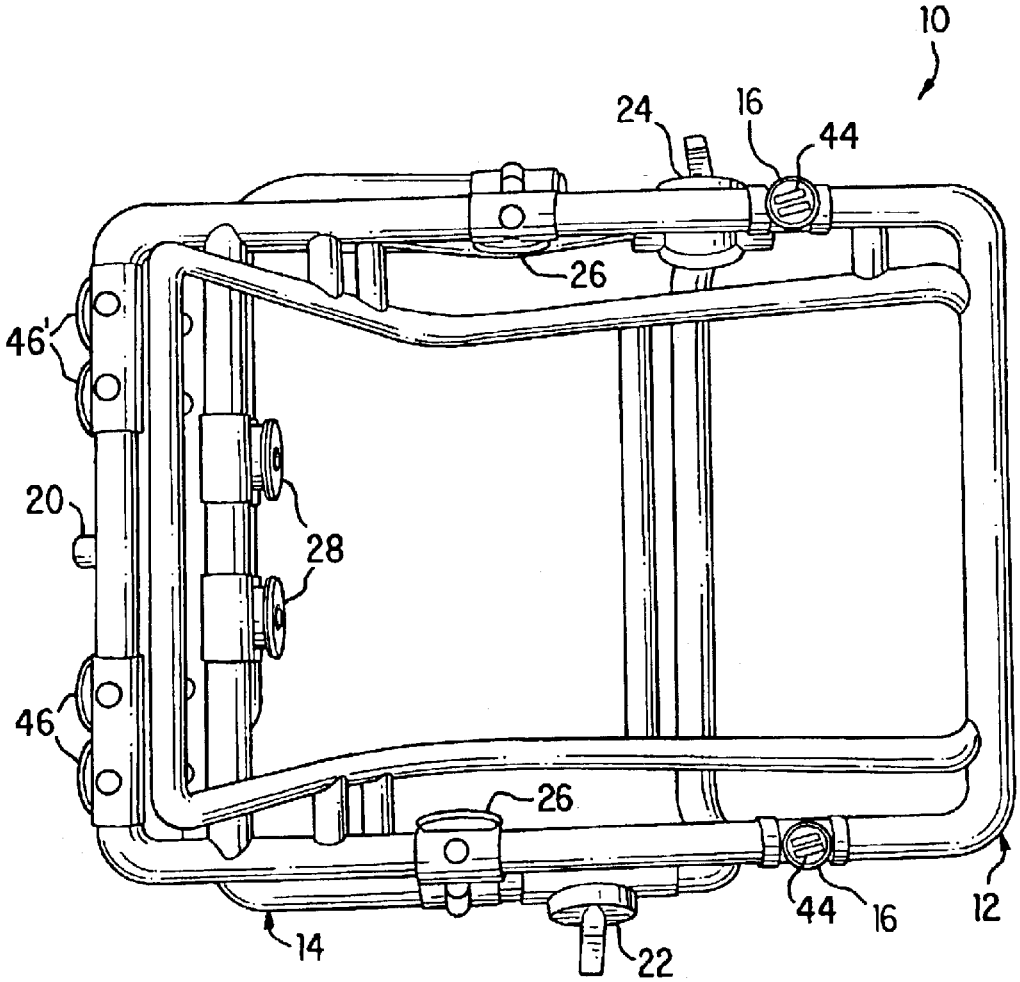
FIG. 3 is a top view of the internal structure of the floating, steerable spa chair.

Referring now to FIGS. 1–3, there is shown a floating, steerable spa chair 10. As shown in FIG. 1, the floating, steerable spa chair 10 floats in a body of water and is adaptable to allow a user 60 to recline within the chair 10 while being partially immersed in water and being doused by water projected through controllable water jets 26. The floating, steerable spa chair 10 further allows user 60 to travel on the body of water with control over steering and speed. In addition to spa jets 26, a plurality of propulsion jets 46, 46', shown in FIGS. 2 and 3, are provided. Control of water pressure of the fluid passing through the propulsion jets 46, 46' is provided by first valve 22, allowing user 60 to control the speed of travel of the spa chair 10, and steering control is provided by second valve 24, shown in FIG. 3.

FIG. 2 of the Drawings shows a side view of the internal structure of the floating, steerable spa chair 10. The chair 10 includes a frame structure formed by an upper frame 12 and a lower frame 14. Both frames 12 and 14 being hollow for fluid transport of air and water, respectively. The frames 12, 14 may be made from lightweight tubular plastic, metal, or any other suitable material which would be rust and decay resistant.

Additionally, a back support 40 may be mechanically fixed to the upper frame 12, or lower frame 14, or both, providing support for user 60 when the user is seated in the spa chair 10. Back support 40 may also be made from a lightweight material, such as plastic, PVC, rust-resistant metal, or the like.

In addition to side spa jets 26, a plurality of rear or back spa jets 28 are further provided, as shown in FIG. 3. The rear jets 28 shower the user's back with a controllable stream of water, with the water pressure being controlled through first valve 22. The spa jets 26, 28 and the propulsion jets 46, 46' may further be adjustable, allowing user 60 to direct the streams of water in any preferred direction. Adjustable jets are well-known in the art and one such adjustable jet is manufactured by Hydro Worx International, Inc. of Middletown, Pa.

Figure 7:
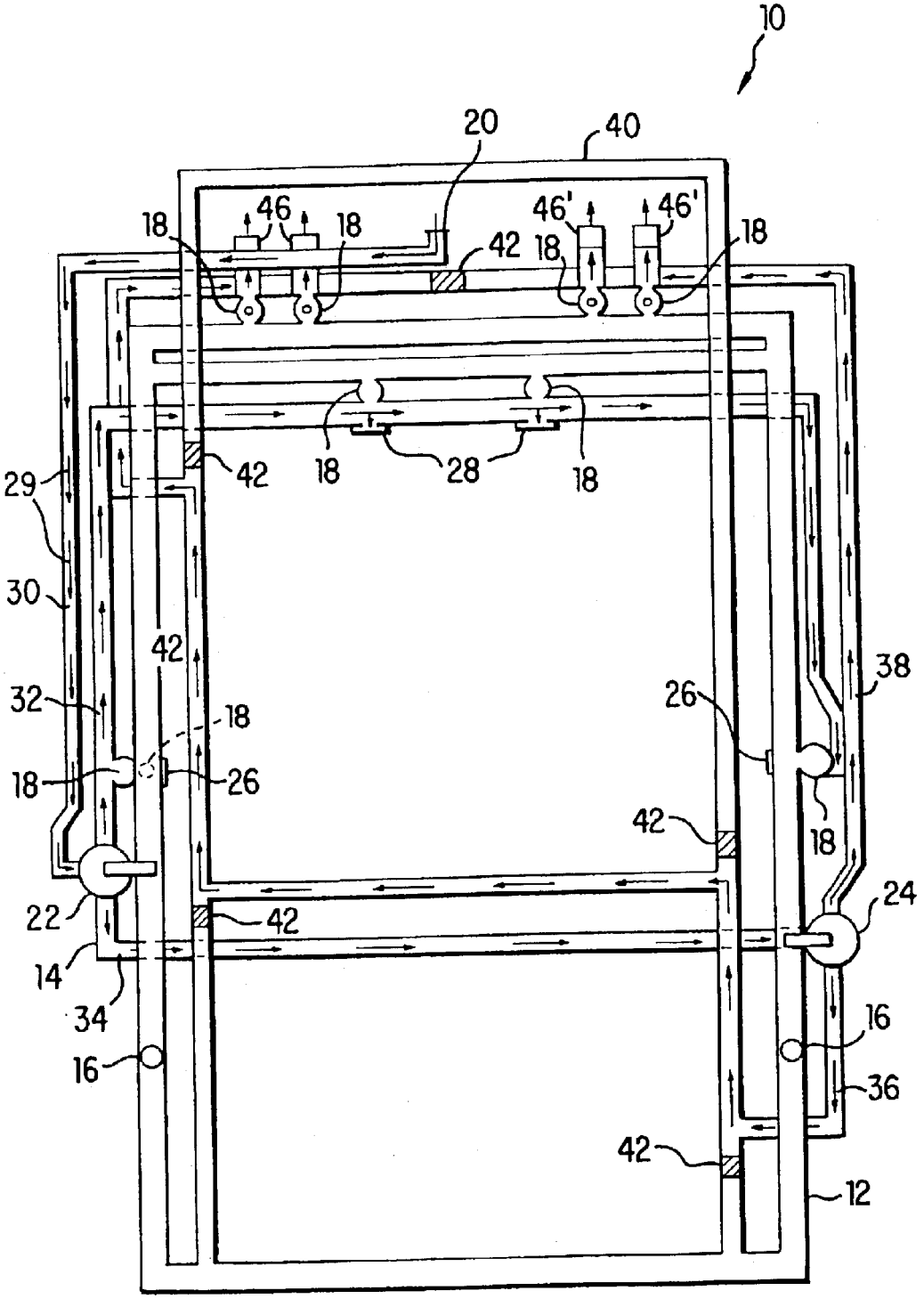
FIG. 7 is a schematic view of the internal structure of the floating, steerable spa chair.

FIG. 7 is a schematic view of the internal structure of the spa chair 10. Pressurized water is received by water inlet 20 formed in lower frame 14. In FIG. 7, arrows 29 denote the initial or first flow of water into lower frame 14 through first flow path 30. The first flow path 30 is intersected by first valve 22. The first valve 22 allows user 60 to selectively control the volume and pressure of water to be delivered to spa jets 26, 28 and to propulsion jets 46. First valve 22 allows the user 60 to proportion the amount of water delivered between second flow path 32, which is received by the spa jets 26, 28, and third flow path 34, which leads to propulsion jets 46, 46' through second valve 24. The user's control over the water pressure/volume in the propulsion jets 46, 46' allows the user to control the speed of the chair 10 when traveling through a body of water. When first valve 22 is operated to increase water flow through the propulsion jets 46, the flow through spa jets 26, 28 is proportionally reduced and vice versa.

Second flow path 32 delivers pressurized water to side spa jets 26 and rear spa jets 28. The third flow path 34 delivers pressurized water to second valve 24. Second valve 24 allows user 60 to proportionally control the volume and pressure of water being delivered the respective pairs of spa jets 46, 46' on the left and right sides of spa chair 10, allowing user 60 to steer the spa chair 10 as it is propelled through the water. Second valve 24 proportionally controls flow between fourth flow path 36 and fifth flow path 38. Fourth flow path 36, originating at second valve 24, delivers the pressurized water to the propulsion jets 46 on the right-hand side of the rear of spa chair 10. Similarly, flow path 38, originating at second valve 24, delivers the pressurized water to the propulsion jets 46' on the left-hand side of the rear of spa chair 10. As shown in FIG. 7, blocks or plugs 42 prevent mixing of the different flow paths and maintain pressure within the pressurized water stream. Increasing water pressure to the propulsion jets 46 on the right-hand side of the rear of spa chair 10 proportionally reduces pressure to propulsion jets 46', and will steer the chair 10 to the user's left. Similarly, increasing water pressure to the left-hand propulsion jets 46' will proportionally reduce pressure of water supplied to propulsion jets 46 and thereby steer the chair 10 to the user's right-hand side.

As shown in FIGS. 2, 3, and 7, the upper frame 12 includes at least one air inlet 16. FIGS. 2 and 3 illustrate air inlet 16 covered by an air valve member 44, allowing user 60 selective control over the amount of air entering upper frame 12. As shown in FIG. 7, upper frame 12 further includes a plurality of air outlets 18 formed therein. Each air outlet 18 is associated with a respective one of jets 26, 28, 46 and 46'. The air valve members 44 allow user 60 to selectively control the degree of aeration of the water from spa jets 26, 28 and propulsion jets 46, 46' by controlling the quantity of air entering the upper frame 12 through at least one air inlet 16. Air outlets 18 of upper frame 12 connect with, the jets 26, 28 46, and 46'. Air is drawn into upper frame 12 through an inlet 16 by the Venturi effect of the jets 26, 28, 46, and 46'. The air exiting through outlets 18 is used to aerate the streams of water projected by the jets 26, 28, 46, and 46'. Additionally, the back-supporting seat member 40, shown in FIG. 2, may act as a separate air flow passage, allowing air drawn through air inlets 16 to pass from the left-hand side of the upper frame to the right-hand side of the upper frame in order to aerate the propulsion jets 46, 46'.

Figure 6:
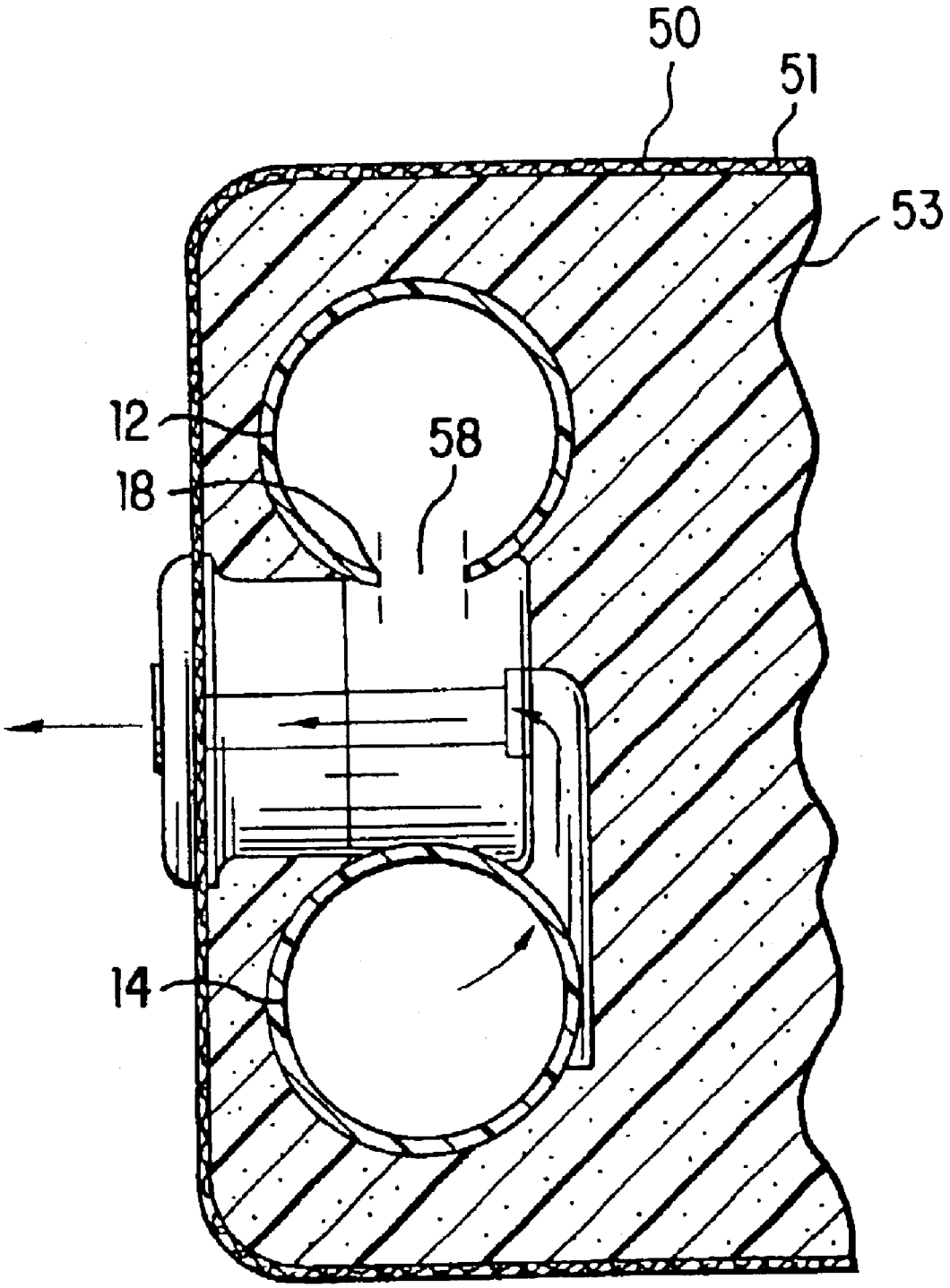
FIG. 6 is a cross-sectional view of a jet of the floating, steerable spa chair.

FIG. 6 is a side cross-sectional view of upper frame 12, lower frame 14, and a jet that is representative of one of jets 26, 28, 46, 46'. Pressurized water flows through lower frame 14 and enters the jet, through which it is expelled. The upper frame 12 is formed with an air outlet 18 positioned in close proximity to the jet. The opening of air outlet 18 forms or is coupled to an open Venturi-type channel 58 between the jet and upper frame 12. Due to the flow of the water through the jet, the air from upper frame 12 is drawn into the jet, by the Venturi effect, and aerates the water stream. The aeration of the water allows for the production of bubbles in the water stream being projected by side jets 26, rear jets 28, and propulsion jets 46, 46'. The projection of the bubbles against the user 60 by the velocity of water exiting the spa jets 26 and 28 has a soothing massaging effect. Thus, the user is able to control the massaging effect by controlling the degree of aeration. The amount of air available for aeration is selectively controlled by air valves 44, shown in FIGS. 2 and 3.

FIGS. 2 and 3 show valves 22 and 24 mounted to lower frame 14. The right-hand valve 22 has an operating lever 21 that allows user 60 to control water flow delivered to side spa jets 26 and rear spa jets 28. The right-hand valve 22 further proportionally controls the quantity and pressure of water delivered to the left-hand valve 24. The left-hand valve 24 has an operating lever 23 that allows user 60 to control the quantity and pressure of water delivered to left-hand propulsion jets 46' and right-hand propulsion jets 46. Therefore, the user can control the speed of the spa chair 10 using valve 22, providing more or less pressurized water to valve 24, while valve 24 is used to control the direction of travel through the body of water. The valves 22, 24 shown in FIGS. 2 and 3 are standard valves that respectively proportion flow from an input port between two outlet ports, which are well-known in the art. One such valve is the Never Lube Jandy Valve produced by the Jandy Corporation of Moorpark, Calif.

Although lever type valve operators are shown, it is understood that other types of valve operators may be used without departing from the inventive concept disclosed herein. As shown in FIG. 7 of the Drawings, water flow is first introduced to valve 22. Valve 22 allows a user to selectively control the quantity and pressure of water being delivered to flow paths 32 and 34. Should the user decide to have all water flow along flow path 32, the water would pass through spa jets 26 and 28 completely, with no water being passed along flow 34, leading to the propulsion jets.

As the user selectively lessens the quantity and pressure of water being delivered along flow path 32, the volume and pressure of water being delivered along flow path 34 proportionally increases. Flow path 34 leads directly to valve 24. The valve 24 allows the user to selectively control the quantity and pressure of water being delivered to left-hand propulsion jets 46' and right-hand propulsion jets 46. The user may selectively choose to set valve 24 in a first position, directing the full quantity of water along flow path 38. Due to the block or stopper 42 positioned between the jets 46, 46', the entire quantity of the water would be delivered to left-hand propulsion jets 46'. As the user selectively lessens the quantity of water being delivered to the left-hand propulsion jets 46', a greater quantity of water is delivered along flow path 36, which due to stoppers 42, is directed entirely through right-hand propulsion jets 46. Thus, the user is given selective control over the quantities and pressures of water being delivered to propulsion jets 46, 46', which allows the user to control the direction of propulsion of the spa chair 10.

First valve 22 controls the proportional quantities of water being delivered to the spa jets 26, 28 and second valve 24 controls the proportional quantities of water being delivered to the propulsion jets 46, 46'. Thus, the first valve 22 allows the user to selectively control the speed of propulsion, and proportionally the pressure of water being delivered to the spa jets 26, 28, and the second valve 24 allows the user to selectively steer the spa chair 10 when floating in a body of water.

Figure 4:
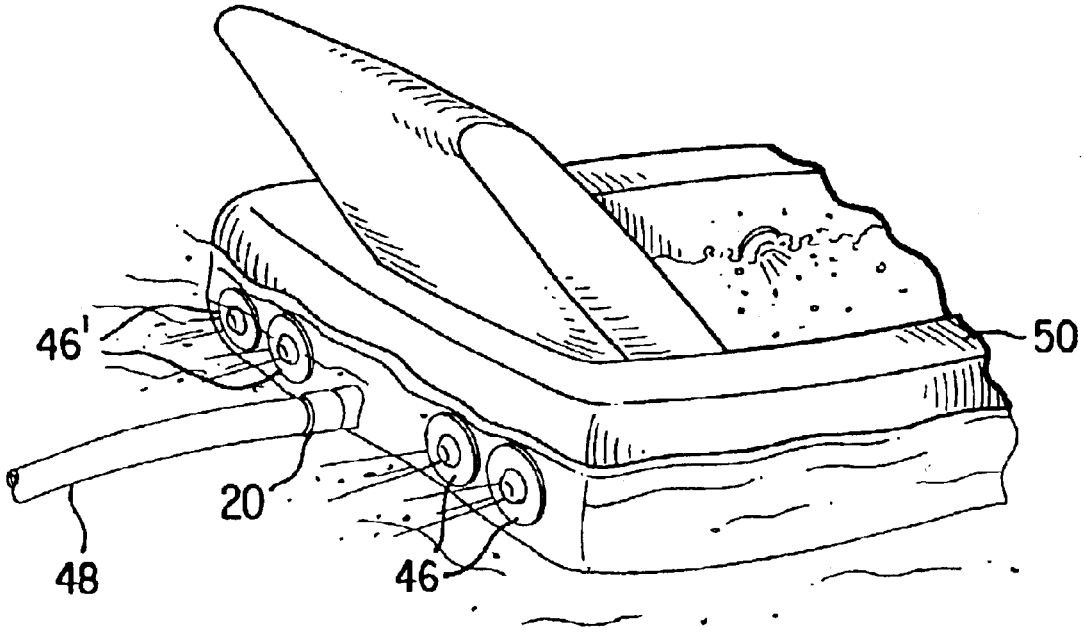
FIG. 4 is a rear partial-view of the floating, steerable spa chair in use.
Figure 5:
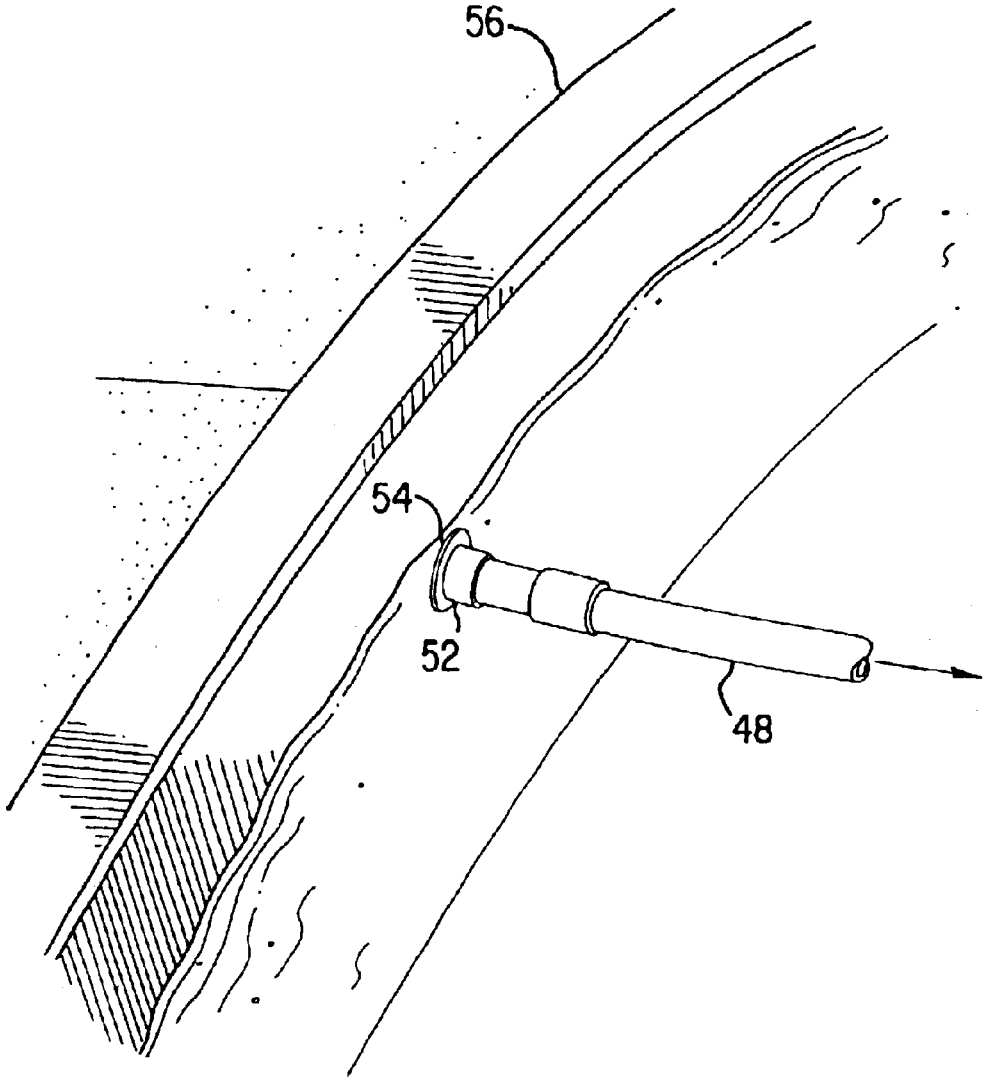
FIG. 5 is a perspective view of the connection between the water supply hose of the floating, steerable spa chair and a source of pressurized water.

As shown in FIG. 2, the water inlet 20 of the lower frame 14 has a threaded connection. This allows for connection to a water hose 48, as shown in FIG. 4 of the Drawings. Water supply hose 48 may be connected to any supply of pressurized water. FIG. 5 illustrates water hose 48 connected to the water pump outlet 54 of a standard swimming pool 56. The hose 48 is connected to outlet 54 by a quick-connect coupling 52. Obviously, the connection of hose 48 to water inlet 20 may be by means of a quick-connect type coupling.

FIGS. 2 and 3 illustrate the internal pipe structure of the floating, steerable spa chair 10. As shown in FIGS. 1, 4, and 6, the internal structure of the chair 10 is preferably covered with a buoyant cushion member 50. Cushion member 50 allows for the comfortable bodily support of user 60, provides buoyancy for the spa chair and user, and is preferably made from a resilient material, such as plastic, foam, inflatable rubber, inflatable plastic, cork, or the like. Cushion member 50 may be formed by a multilayer structure, including at least one inner layer or core 53 overlaid by an outer layer 51. Outer layer 51 may be formed of a woven fabric or plastic, or formed of a higher density foam than that of the core 53.

Figure 8:
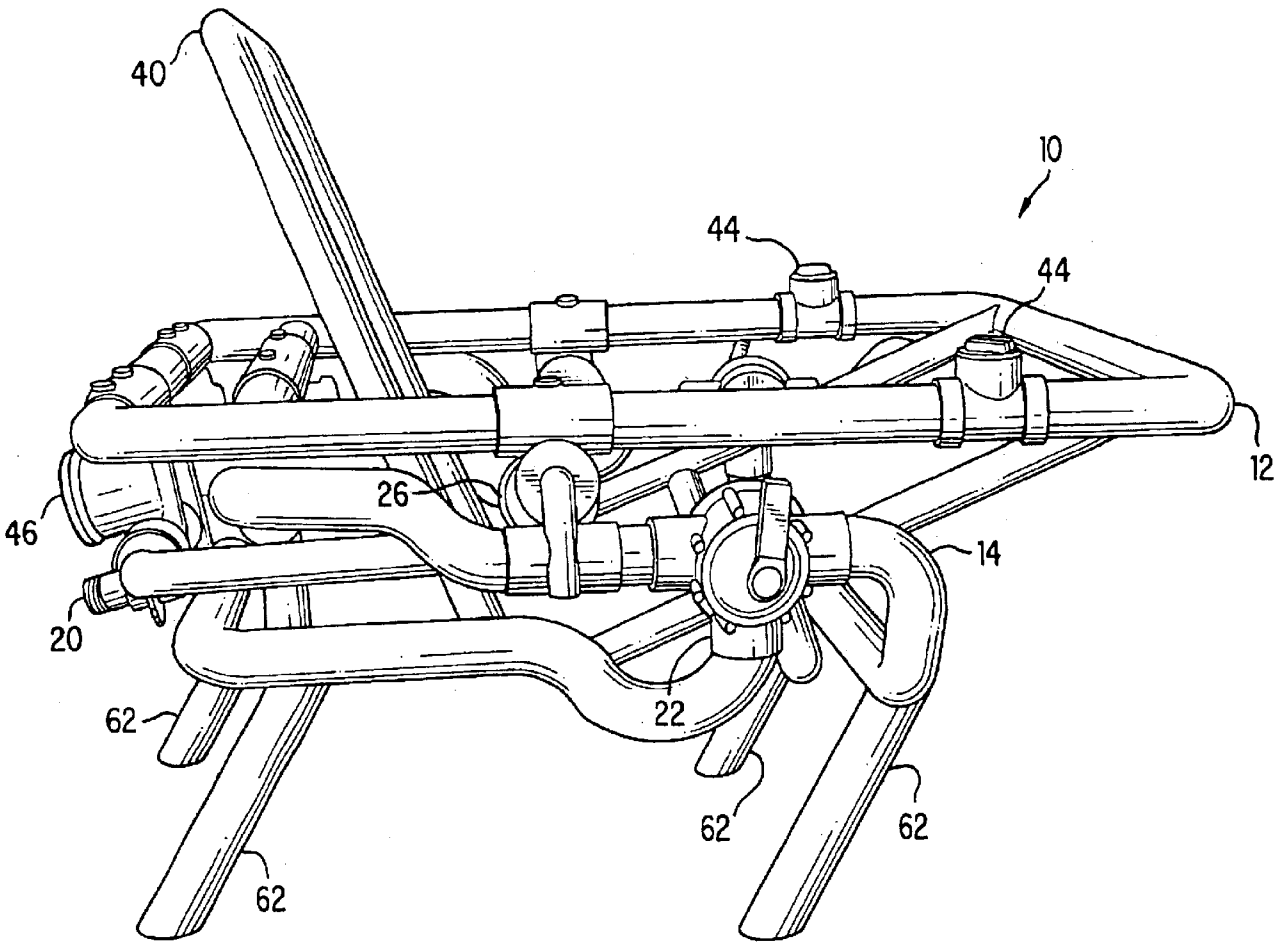
FIG. 8 is a side view of the internal structure of an alternate embodiment of the floating, steerable spa chair.

Although shown floating on water in FIGS. 1 and 4, the floating, steerable spa chair 10 may also include a plurality of detachable supports or legs 62, shown in FIG. 8, allowing the chair 10 to rest on a surface, such as the deck adjacent to a pool. When at rest on a surface, the spa chair 10 may still be used to therapeutically or recreationally douse user 60 with water generated by side jets 26 and rear jets 28. Although shown in FIG. 8 as being attached to the lower frame 14, the removable leg 62 may be removably fixed to the lower frame 14, the upper frame 12, or any other convenient portion of the spa chair 10.

Although this invention has been described in connection with specific forms and embodiments thereof, it will be appreciated that various modifications other than those discussed above may be resorted to without departing from the spirit scope of the invention. For example, functionally equivalent elements may be substituted for those specifically shown and described without departing from the spirit or scope of the invention as defined in the appended claims.

What is claimed is:

1. A floating, steerable spa chair comprising:

an upper hollow frame having at least one air inlet and a plurality of air outlets formed therein; and, a lower hollow frame having a water inlet and first and second valve coupled in fluid communication with said water inlet, said lower hollow frame having a plurality of spa jets and a plurality of propulsion jets coupled thereto, said first valve selectively controlling water flow to said plurality of spa jets, said second valve selectively controlling water flow to said plurality of propulsion jets, said plurality of air outlets of said upper hollow frame being in communication with respective ones of said plurality of spa and propulsion jets to provide aeration to water propelled through said spa and propulsion jets.

2. The floating, steerable spa chair as recited in claim 1 wherein said plurality of air outlets communicate with said plurality of spa and propulsion jets through Venturi-type channels.

3. The floating, steerable spa chair as recited in claim 1 wherein said second valve allows a user to selectively steer the floating, steerable spa chair.

4. The floating, steerable spa chair as recited in claim 1 wherein said water inlets is coupled in fluid communication with a source of pressurized water.

5. The floating, steerable spa chair as recited in claim 1 further comprising a support member for supporting a user's body.

6. The floating, steerable spa chair as recited in claim 1 further comprising a plurality of detachable legs coupled to said lower hollow frame for support said floating, steerable spa chair on a surface.

7. The floating, steerable spa chair as recited in claim 1 further comprising a cushion member for covering said upper and lower frames.

8. The floating, steerable spa chair as recited in claim 1 wherein said first valve allows a user to selectively control speed of propulsion of said floating, steerable spa chair.

9. The floating, steerable spa chair as recited in claim 3 wherein said first valve allows a user to selectively control speed of propulsion of said floating, steerable spa chair.

10. The floating, steerable spa chair as recited in claim 1 wherein air flow through said at least one air inlet is selectively controlled by at least one air valve in respective communication with said at least one air inlet.

11. The floating, steerable spa chair as recited in claim 7, wherein said cover member is formed of a buoyant material for buoyantly supporting a user in said floating, steerable spa chair.

12. A floating and steerable spa chair releasably coupled to a source of pressurized water, comprising:

a tubular frame having a water inlet adapted for fluid coupling to the source of pressurized water and a plurality of outlets, said tubular frame including (a) a portion thereof configured to provide support of upper and lower portions of a user's body, (b) a first valve having a first inlet port coupled in fluid communication with said water inlet and a pair of outlets, said first valve having an operator for selectively proportioning fluid flow from said first inlet port between said pair of outlets, (c) a plurality of spa jets coupled in fluid communication with a first of said pair of outlets of said first valve, and (d) a plurality of propulsion jets coupled in fluid communication with a second of said pair of outlets of said first valve; and, a buoyant material coupled to said tubular frame, wherein said first valve proportions the pressurized water between (1) full flow to said plurality of spa jets with no flow to said plurality of propulsion jets and (2) no flow to said plurality of spa jets with full flow to said plurality of propulsion jets.

13. The floating and steerable spa chair as recited in claim 12, wherein said plurality of propulsion jets include at least a first propulsion jet and a second propulsion jet, said first and second propulsion jets being laterally spaced one from the other.

14. The floating and steerable spa chair as recited in claim 13, wherein said tubular frame further includes a second valve having a second inlet port fluidly coupled to said second outlet of said first valve and a pair of outlets, said second valve having an operator for selectively proportioning fluid flow from said second inlet port between said pair of outlets of said second valve, said first propulsion jet being coupled in fluid communication with a first of said pair of outlets of said second valve and said second propulsion jet being coupled in fluid communication with a second of said pair of outlets of said second valve, wherein said second valve proportions the pressurized water from said second outlet of said first valve between (1) full flow to said first propulsion jet with no flow to said second propulsion jet and (2) no flow to said first propulsion jet with full flow to said second propulsion jet.

15. The floating and steerable spa chair as recited in claim 12, wherein said tubular frame has a first hollow frame member for delivering air to said spa jets and propulsion jets, and a second hollow frame member for delivering water to said spa jets and propulsion jets.

16. The floating and steerable spa chair as recited in claim 12, wherein a plurality of detachable legs are coupled to said tubular frame.

17. The floating and steerable spa chair as recited in claim 15, wherein said first hollow tubular frame member includes a plurality of air inlets.

18. The floating and steerable spa chair as recited in claim 17, wherein each of said air inlets has a user-controllable air valve fixedly secured thereto.

19. The floating and steerable spa chair as recited in claim 15, wherein each of said propulsion jets and each of said spa jets is in fluid communication with both said first hollow tubular frame member and said second hollow tubular frame member.

20. The floating and steerable spa chair as recited in claim 19, wherein said first hollow tubular frame member and said second hollow tubular frame member fluidly communicate within each of said spa and propulsion jets through a Venturi-type channel for aeration of water expelled through said jets.

* * * * *